US005893061A

United States Patent [19]

Gortz

[11] Patent Number: 5,893,061

[45] Date of Patent: Apr. 6, 1999

[54] METHOD OF SYNTHESIZING A BLOCK OF A SPEECH SIGNAL IN A CELP-TYPE CODER

[75] Inventor: Udo Gortz, Bochum, Germany

[73] Assignee: Nokia Mobile Phones, Ltd., Salo, Finland

[21] Appl. No.: 744,683

[22] Filed: Nov. 6, 1996

[30] Foreign Application Priority Data

Nov. 9, 1995 [EP] European Pat. Off. ..... 95117720

[51] Int. Cl.[6] ..... G10L 9/14

[52] U.S. Cl. ..... 704/262; 704/258; 704/264; 704/220

[58] Field of Search ..... 704/258, 220, 704/264, 223, 262

[56] References Cited

U.S. PATENT DOCUMENTS

| | | | |
|---|---|---|---|
| 4,868,867 | 9/1989 | Davidson et al. | 704/264 |
| 5,060,269 | 10/1991 | Zinser | 381/38 |
| 5,233,660 | 8/1993 | Chen | 704/264 |
| 5,295,203 | 3/1994 | Krause et al. | 382/56 |
| 5,327,520 | 7/1994 | Chen | 704/264 |
| 5,396,576 | 3/1995 | Miki et al. | 704/264 |
| 5,444,816 | 8/1995 | Adoul et al. | 395/2.28 |
| 5,483,668 | 1/1996 | Malkamaki et al. | 455/33.2 |
| 5,602,961 | 2/1997 | Kolesnik | 704/223 |
| 5,664,055 | 9/1997 | Kroon | 704/223 |
| 5,701,392 | 12/1997 | Adoul et al. | 704/223 |
| 5,719,994 | 2/1998 | Bouraoui | 704/223 |
| 5,732,389 | 3/1998 | Kroon et al. | 704/223 |

OTHER PUBLICATIONS

Satoru "8 kbits/s speech coder with pitch adpative vector quantizer", Apr. 1986.

Cuperman "17 a 6 kbps Regular Pulse CELP coder for mobile radio communications", Sep. 1989.

Kleijn "fast method for the CELP speech coding algorithm", Aug. 1990.

Satoru "8 kbits/s speech coder with pitch adpative vector quantizer", Apr. 1986.

Cuperman "17 a 6 kbps Regular Pulse CELP coder for mobile radio communications", Sep. 1989.

Kleijn "fast method for the CELP speech coding algorithm", Aug. 1990.

ICASSP 86, Proceedings, vol. 3, 7–11 Apr. 1986 Tokyo, Japan, pp. 1697–1700, Satoru Iai and Kazunari Irie "8 kbits/s Speech Coder with Pitch Adaptive Vector Quantizer".

Advances in Speech Coding, Vancouver, Sep. 5–8, 1989, 1 Jan. 1991 Atal B S; Cuperman V; Gersho A, pp. 179–188 Delprat M. et al. "17 A 6 KPS Regular Pulse CELP Coder For Mobile Radio Communications".

IEEE Transactions On Acoustics, Speech and Signal Processing, vol. 38, No. 8, 1 Aug. 1990, pp. 1330–1341, Kleijn W.B. et al. "Fast Methods For The Celp Speech Coding Algorithm".

Area Communication, Stockholm, Jun. 13–17, 1988, 13 Jun. 1988 Institute of Electrical and Electronics Engineers, pp. 24–27, Lever M. et al., "RPCELP: A High Quality and Low Complexity Scheme For Narrow Band Coding Of Speech".

*Primary Examiner*—David R. Hudspeth
*Assistant Examiner*—Daniel Abebe
*Attorney, Agent, or Firm*—Perman & Green, LLP

[57] ABSTRACT

A new scheme to generate the stochastic excitation for a CELP-type speech codec based upon a hybrid stochastic codebook search technique including use of regular pulse excitation codebooks is described. From the ideal RPE sequence the position of the first nonzero pulse and the position of the pulse with maximum amount as well as the overall sign of the RPE sequence are determined. The corresponding target vectors and pulse responses of the synthesis filter are stored in databases belonging to the positions of the maximum pulse, respectively. These databases are used to derive the stochastic codebook via the so-called LBG-algorithm. Once the codebook has become available, the position of the maximum pulse serves as pre-selection measure to limit the search for the "best" candidate vector to a "small" subset of the stochastic codebook.

4 Claims, 6 Drawing Sheets

METHOD OF SYNTHESIZING A BLOCK OF A SPEECH SIGNAL IN A CELP-TYPE CODER

DESCRIPTION

This invention relates to speech coding, particularly to a method of synthesizing a block of a speech signal in a CELP-type (Code Excited Linear Predictive) coder, the method comprising the steps of applying an excitation vector to a synthesizer filter of the coder, said excitation vector consisting of two gain normalized components derived, on the one hand, from an adaptive codebook and from a stochastic codebook, on the other hand.

Efficient speech coding methods are continuously developed. The principles of Code Excited Linear Prediction (CELP) are described in an article of M. R. Schroeder and B. S. Atal: "Code-Excited Linear Prediction (CELP): High Quality Speech at Very Low Bit Rates" Proceedings of the IEEE International Conference of Acoustics, Speech and Signal Processing—ICASSP, Volume 3, pp 937–940, March 1985. The basic structure of the CELP-type speech coders developed up to date is quite similar. A LPC synthesis filter (LPC=Linear Predictive Coding) is excited by so-called "adaptive" and "stochastic" excitations. The speech excitation vector is scaled by its respective gain and the gains are often Jointly optimized.

The CELP approach offers good speech quality at low bit rates, however, degradations of speech quality can be heard if the synthesized speech is compared with the original (band limited) speech, especially at bit rates below 16 kb/sec. One reason is the need to restrict the computational requirements of the search for the "best" excitation to reasonable values in order to make the algorithm practical. Therefore many CELP-type coders use simplified structures for the codebooks as already indirectly suggested by Schroeder/Atal in the said basic article. Such methods cause some degradations in speech quality. It is known that the speech quality is strongly related to the "quality" of the stochastic codebook(s) which give(s) the innovation sequence for the speech signal to be synthesized. Although it is possible to implement very good full search codebooks at reasonable data rates, it is still impossible to implement a full search in real time on existing digital signal processors. For overcoming this problem a reasonable approach is a pre-selection of a relatively small number of "good" code vector candidates, so that the codebook search can be done in real time and the speech quality is retained.

So-called trained codebooks can have adavantages over algebraic codebooks in terms of speech quality, nevertheless, in a lot of today's CELP-type speech coders algebraic codebooks are employed to provide the stochastic excitation to reduce complexity and memory requirements.

FIG. 1 shows the typical structure of an "analysis-by-synthesis-loop" of a CELP-type speech codec. A common scheme is that the synthesis filter, i.e. blocks 1 and 2, providing the spectral envelope of the speech signal to be coded is excited with two different excitation parts. One of them is called "adaptive excitation". The other excitation part is called "stochastic excitation". The first excitation part is taken from a buffer where old excitation samples of the synthesis filter are stored. Its task is to insert the harmonic structure of speech. The second excitation part is a so-called stochastic excitation which rebuilds the noisy components of the signal. Both excitation parts are taken from "codebooks", i.e. from an adaptive codebook 3 and from a stochastic codebook 4. The adaptive codebook 3 is time variant and updated each time a new excitation of the synthesis filter has been found. The stochastic codebook 4 is fixed. A synthetic speech signal is generated already in the speech encoder by a process called "analysis-by-synthesis". Codebooks 3, 4 are searched for the vectors which scaled and filtered versions (gains g1, g2) give the "best" approximation of the signal to be transmitted as "reconstructed target vector". The "best" excitation vectors are chosen according to an error measure (block 5) which is computed from the perceptual weighted error vector In block 6.

In theory, the approximation of the target vector can be performed quite well in terms of perception even at relatively low bit rates. In practice, however, there are limitations namely, as already mentioned, the time required to perform the codebook search and the memory needed to store the codebooks. Therefore, only suboptimal search procedures can be applied to keep the complexity low. The codebooks 3, 4 are searched for the "best" code vector sequentially and each single codebook search is performed also suboptimal to some extent. These limitations can cause a perceptible decrease in speech quality. Therefore, a lot of work has been done in the past to find the excitation with reasonable effort while retaining high speech quality. One approach for simplifying the search procedures is described in EP-A-0 515 138.

Typically, CELP coders are driven by the stochastic excitation, since the adaptive codebook 3 only depends on vectors previously chosen from the stochastic codebook 4. For this reason, the content of the stochastic code book 4 is not only important for rebuilding noisy components of speech but also for the reproduction of the harmonic parts. Therefore, most CELP-type coders mainly differ in the stochastic excitation part. The other parts are often quite similar.

As already mentioned there are two different stochastic codebook approaches, i.e. trained codebooks and algebraic codebooks. Trained codebooks often have candidate vectors with all samples being nonzero and different in amplitude and sign. In contrast, algebraic codebooks usually have only a few nonzero samples and often the amplitudes of all nonzero samples are set to one. A full search in a trained codebook takes more complexity than a full search in an algebraic codebook of the same size. In addition, there is no memory required to store an algebraic codebook, since the candidate vectors can be constructed online during the codebook search is performed. Therefore, an algebraic codebook seems to be the better choice. However, to ensure good reproduction of speech, a "large" number of different codevector candidates including speech characteristics is needed. Due to this, trained codebooks have advantages over algebraic ones. On the other hand, the "best" candidate vector should be found with "small" effort. These are contrary requirements.

SUMMARY OF THE INVENTION

It is an object of the invention to make trained codebooks applicable by a new process of preselecting a reasonable number of candidate codevectors in order to limit the "closed-loop" search for the best codevector to a "small" subset of candidate codevectors.

It is a further object of the invention to do such preselection with limited efforts such that the following codebook search applied to the preselected candidate vectors takes clearly less complexity than a full search in the codebook.

As a first approach to the invention such preselection measure is derived from an "ideal" RPE sequence (RPE= Regular Pulse Excitation).

According to the invention a method for synthesizing a block of a speech signal in a CELP-type coder comprises the step of applying an excitation vector to a synthesizing filter of the coder, said excitation vector consisting of two gain normalized components derived, on the one hand from an adaptive codebook and from a stochastic codebook, on the other hand, said method being characterized in that for limiting the computational effort of the stochastic codebook components search, an ideal regular pulse excitation sequence is computed from a target vector derived from a weighted speech sample signal and the impulse response of the synthesis filter followed by determination of four parameters therefrom, namely

- the position of the first nonzero pulse of the ideal RPE excitation sequence,
- the position of the maximum pulse within said RPE excitation sequence,
- the overall sign of the RPE sequence defined as the respective sign of said maximum pulse, and
- the position of the corresponding part of the pulse codebook. as the position of the maximum pulse,
- said four parameters being transmitted to the speech decoder.

The starting point of the invention is the Regular Pulse Excitation (RPE) which Is principally known since the early eighties. The invention, however, takes specific advantages from this approach.

In the following, the computing of an ideal RPE is briefly described. For more details specific reference is made to a paper by Peter Kroon: "Time-domain coding of (near) toll quality speech at rates below 16 kb/s", Delft University of Technology, March 1985.

The Regular Pulse Excitation (RPE)

Assume the excitation vector to be N samples long. In general, each of those samples has different sign and amplitude. In practice, it is necessary either to limit the number of codevectors and/or to reduce the number of nonzero pulses in the excitation vector in order to make codebook search possible with today's signal processors. One possibility to reduce the number of nonzero pulses is to employ RPE. RPE means, that the spacing between adjacent nonzero pulses is constant. If for example every second. excitation pulse has nonzero amplitude, there are two possibilities to place N/2 nonzero pulses in a vector of the length N. The first, third, fifth, . . . pulse is nonzero or the second. fourth, sixth, . . . pulse is nonzero. If the number of nonzero pulses is L, L<=N, every (N/L)-th pulse is nonzero and there are (N−(N/L)*(L−1)) possibilities to place L nonzero pulses as RPE sequence in a vector of length N (both divisions are integer-divisions). That means the first nonzero pulse can be located at (N−(N/L)*(L−1)) different positions. The best set of pulse amplitudes for those different possibilities can be computed in a straightforward manner. The following variables are defined:

| | |
|---|---|
| p | target vector to rebuild, (1*N)-Matrix |
| h | impulse response of synthesis filter, (1*N)-Matrix |
| H | impulse response matrix, (N*N)-Matrix |
| M | matrix which gives the contribution of the nonzero pulses in excitation vector, (N*L)-Matrix |
| b | vector containing L non zero pulse amplitudes and signs, (1*L)-Matrix |
| c | excitation vector, (1*N)-Matrix |
| c' | filtered excitation vector, (1*N)-Matrix |
| e | difference vector between target vector and filtered code-vector (error vector) |
| E | error measure. |

The excitation vector is given by $$c=b\cdot M,$$

the matrix product of vector b and matrix M. Its filtered version is $$c'=b\cdot M\cdot H.$$

The error to be minimized is the difference between the target vector and this signal.

$$e=p-c'$$

The error measure is the simple Euclidean distance measure.

$$E=e\cdot e^T$$

Replacing e by the above given equations, we obtain $$E=p\cdot p^T-2\cdot H^T\cdot M^T\cdot b^T+b\cdot M\cdot H\cdot H^T\cdot M^T\cdot b^T.$$

The partial derivation $$\frac{\partial E}{\partial b^T}=0$$

leads to the "best" set of amplitudes and signs which are computed by $$b^T=p\cdot H^T\cdot M^T\cdot(M\cdot H\cdot H^T\cdot M^T)^{-1}.$$

The impulse response matrix H looks like $$H=\begin{matrix} h(0) & h(1) & h(2) & h(3) & .. & h(N-1) \\ 0 & h(0) & h(1) & h(2) & .. & h(N-2) \\ 0 & 0 & h(0) & h(1) & .. & h(N-3) \\ 0 & 0 & 0 & h(0) & .. & h(n-4) \\ .. & .. & .. & .. & .. & .. \\ 0 & 0 & 0 & 0 & 0 & h(0) \end{matrix}$$

If, for example, L=N/2, M is structured as shown below for the first and second possibility to place pulses, respectively.

$$M^{(1)}=\begin{matrix} 1 & 0 & 0 & 0 & 0 & 0 & 0 & .. & .. & 0 \\ 0 & 0 & 1 & 0 & 0 & 0 & 0 & .. & .. & 0 \\ 0 & 0 & 0 & 0 & 1 & 0 & 0 & .. & .. & 0 \\ .. & .. & .. & .. & .. & .. & .. & .. & .. & .. \\ 0 & 0 & 0 & 0 & 0 & 0 & 0 & .. & 1 & 0 \end{matrix}$$

$$M^{(2)}=\begin{matrix} 0 & 1 & 0 & 0 & 0 & 0 & 0 & .. & .. & 0 \\ 0 & 0 & 0 & 1 & 0 & 0 & 0 & .. & .. & 0 \\ 0 & 0 & 0 & 0 & 0 & 1 & 0 & .. & .. & 0 \\ .. & .. & .. & .. & .. & .. & .. & .. & .. & .. \\ 0 & 0 & 0 & 0 & 0 & 0 & 0 & .. & .. & 1 \end{matrix}$$

In general, each row of M has just a single element being 1, the other elements are zero. The n-th row gives the position of the n-th pulse. If there are m possibilities to place L pulses as RPE sequence, there are m different versions of the matrix M. With m different matrixes M, there are also m different sets of amplitudes. The set which provides the smallest error E is denoted as "ideal" RPE sequence.

This method applied here may be called "hybrid" since the preselection of codevectors to be tested in the "analysis-by-synthesis-loop" is done outside of said loop. The part of the codebook to which those loop search is applied is determined before the analysis-by-synthesis-loop is entered.

BRIEF DESCRIPTION OF THE DRAWING

The new synthesizing method according to the invention and adavantageous examples therefore are described in detail in the following with reference to the drawings in which.

DETAILED DESCRIPTION OF THE INVENTION

At first, the RPE based preselection of a stochastic codebook part and the derivation of the pulse codebook are described with reference to FIGS. 2(*a*), 2(*b*), 3 and 4.

The maximum pulse position of an "ideal" RPE sequence is used as preselection measure to limit the closed loop codebook search to a "small" number of candidate vectors.

Figure 1:
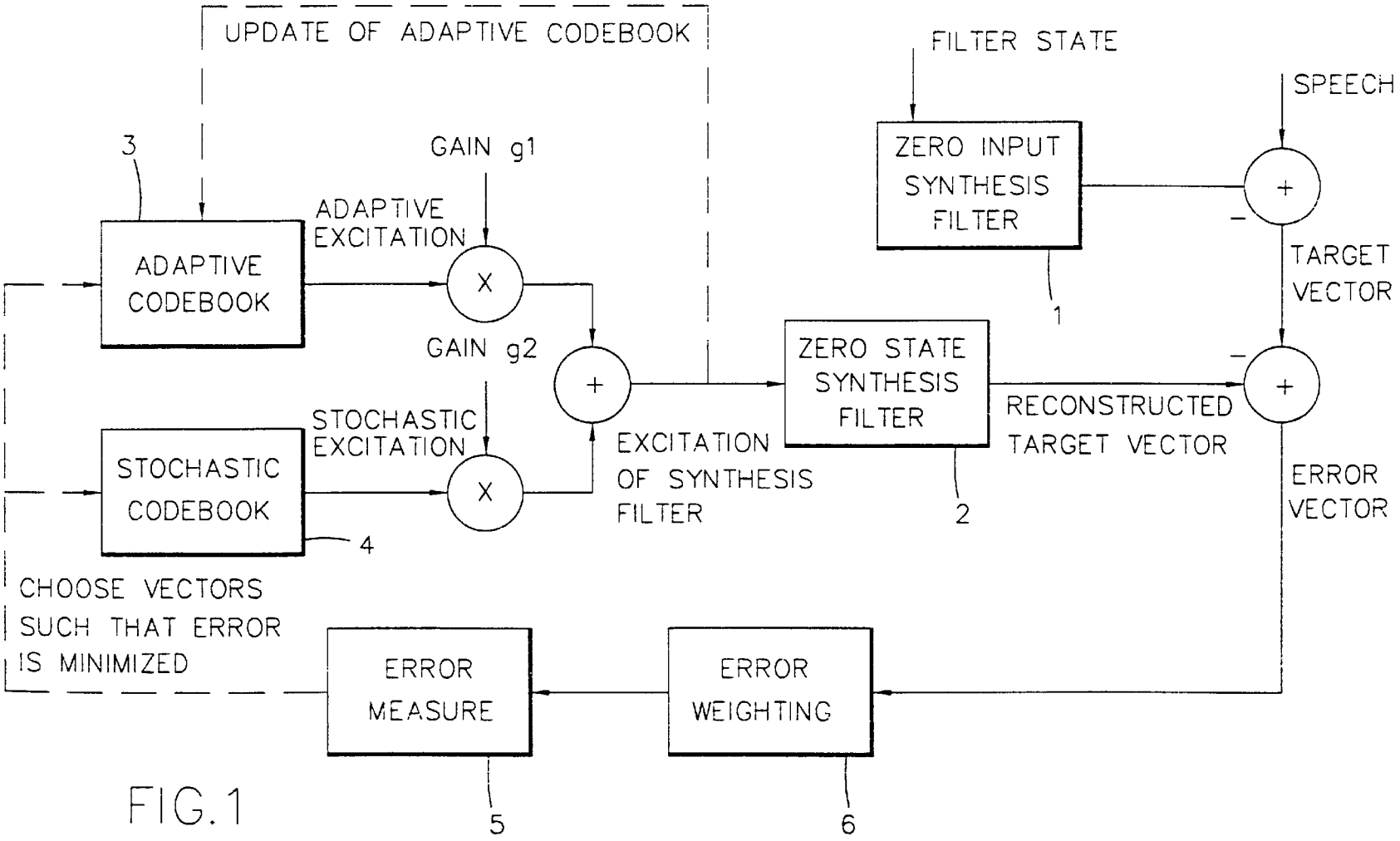
FIG. 1 shows a speech analysis-by-synthesis-loop already explained above.
Figure 2A:
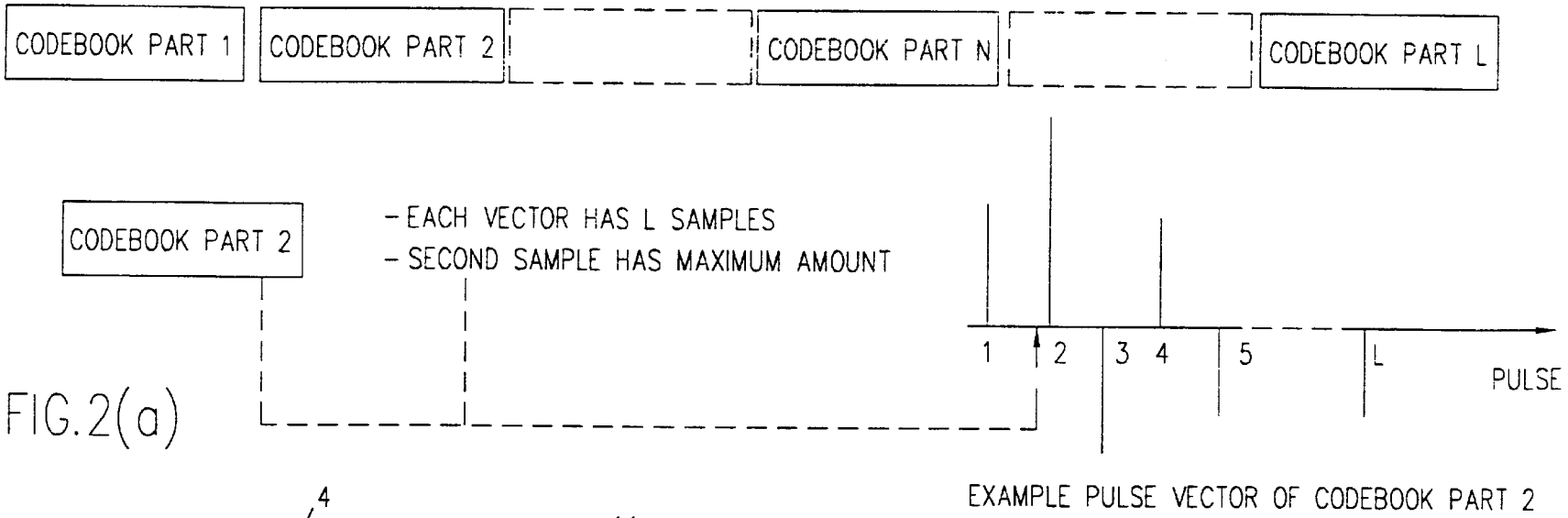
FIGS. 2(*a*) and 2(*b*) serve to explain a stochastic pulse codebook in its relation to an excitation generator.
Figure 2B:
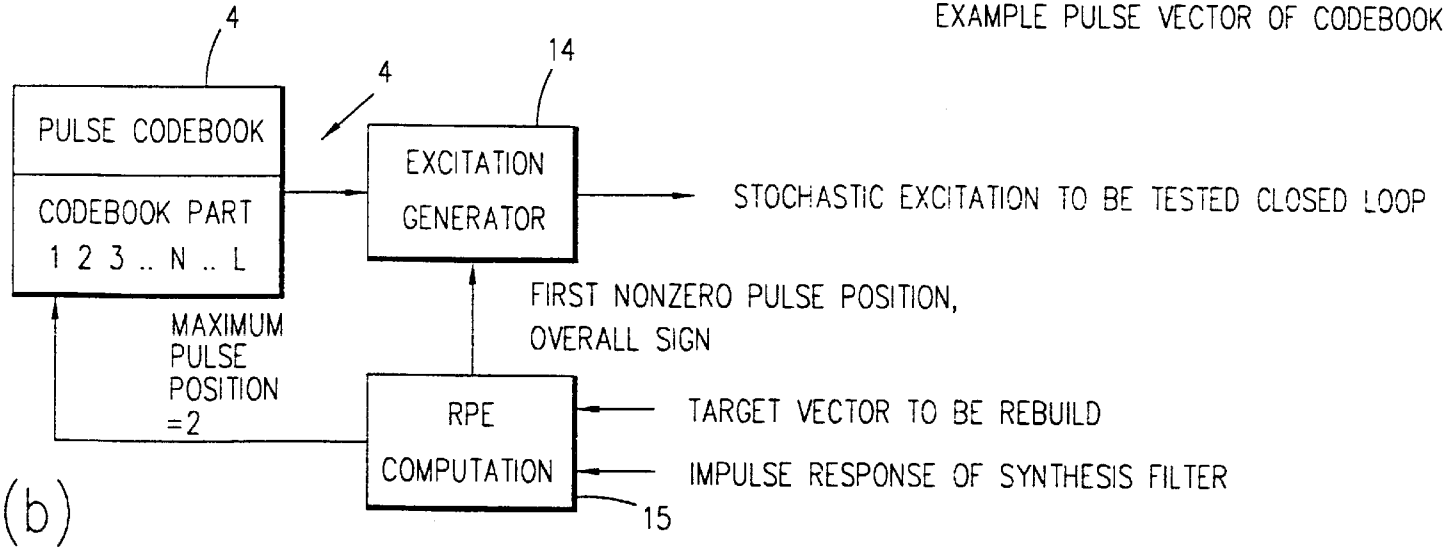

Assume the codebook structure given in FIG. 2(*a*) to be available. There is a pulse codebook having L parts (L=number of nonzero samples). Codebook part i (i=1,2, . . . ,L) consists of $M_i$ vectors of L samples. These vectors are candidate vectors for the nonzero pulses of an RPE sequence. The n-th sample of all vectors of the n-th part has maximum amount. The L parts are joined together to one codebook.

FIG. 2(*b*) shows as example for codebook part 2, how the preselection procedure works and a code vector is constructed. The "ideal" RPE sequence is computed as depicted in keywords in FIG. 2(*a*) and FIG. 2(*b*). The position of the first nonzero pulse, the maximum pulse position and the overall sign are taken from the "ideal" RPE. If the maximum pulse is negative, the overall sign is negative. Otherwise the overall sign is positive. The overall sign is required since the pulse codebook 4*a* contains only codevectors with positive maximum pulse.

Figure 3:
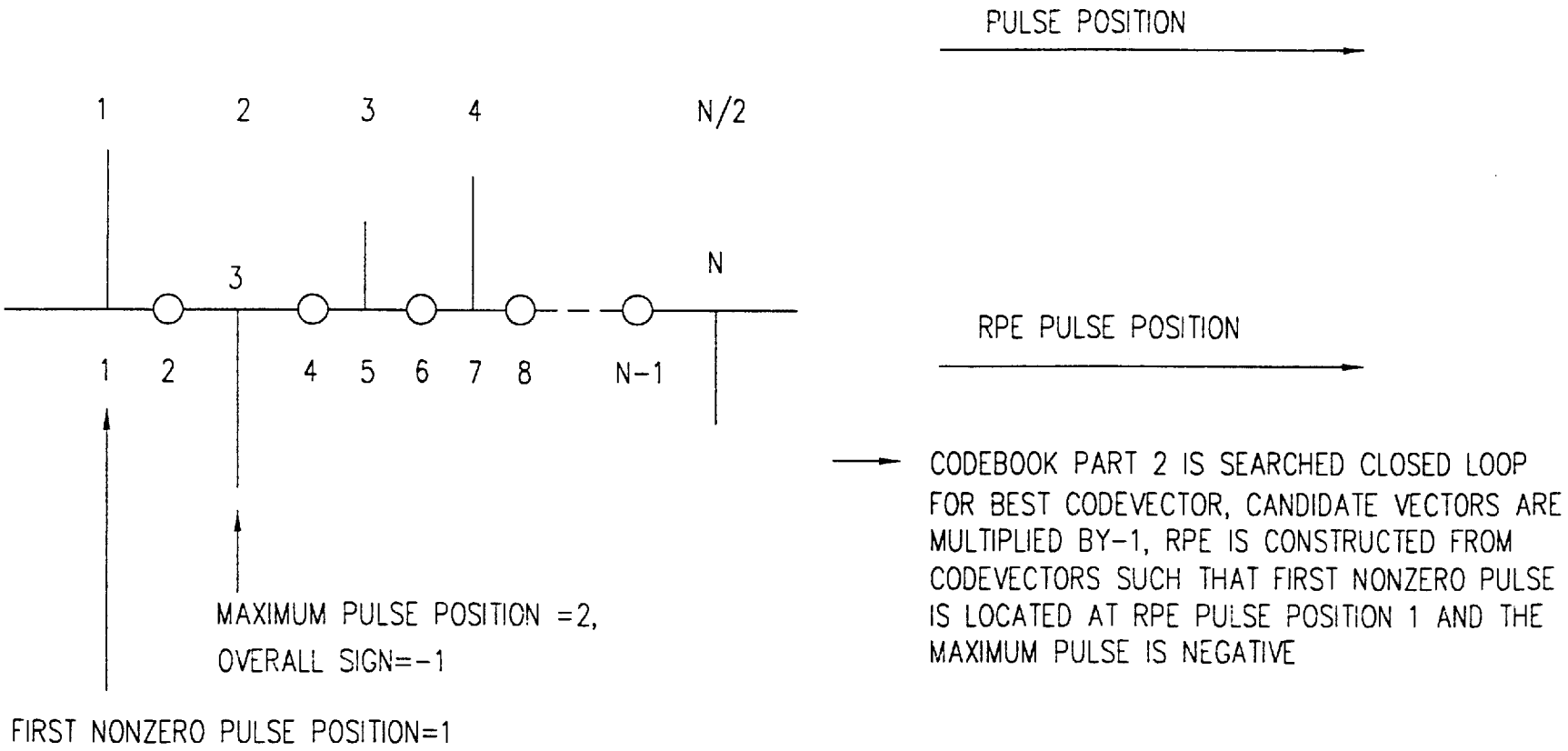
FIG. 3 gives an example for L=N/2 pulses in an ideal RPE sequence in accordance with the invention.
Figure 4:
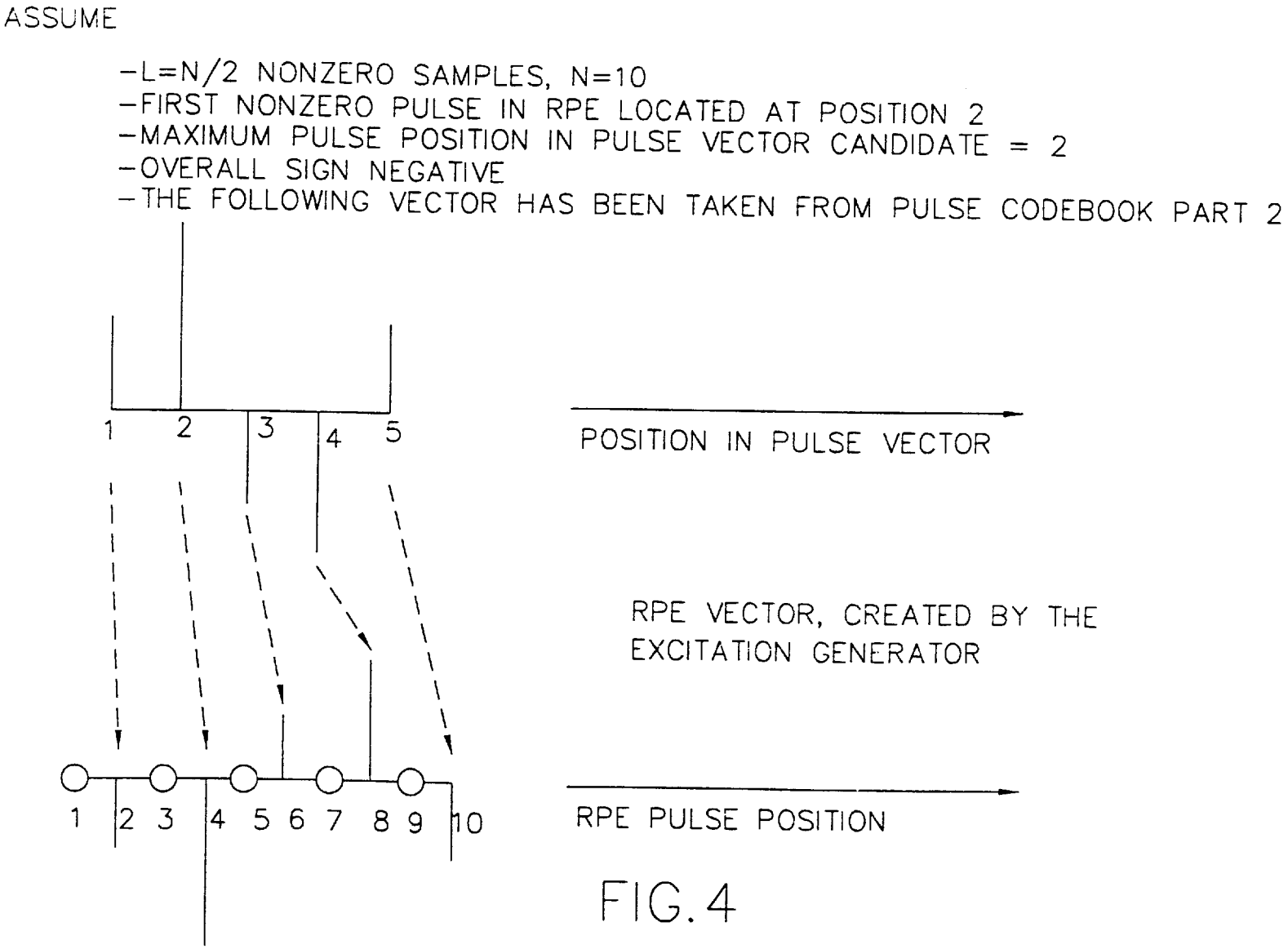
FIG. 4 explains the functioning of an excitation generator.

FIG. 3 shows the derivation of the "position of a first nonzero pulse", the "maximum pulse position" and the "overall sign" from an example RPE sequence. FIG. 4 gives an example how the excitation generator 14 of FIG. 2(*b*) works. If the ideal RPE's maximum pulse is negative, all pulses of the pulse vector to be tested are multiplied by −1. If the n-th nonzero sample of the ideal RPE sequence has maximum amount, the n-th part of the pulse codebook is searched for the best candidate vector. That means that as a significant advantage of the invention, the codebook search is applied to Just (100/(L))% of all candidate vectors.

As a result, the following parameters are transmitted to the speech decoder:

position of the first nonzero pulse, position of the maximum pulse (=codebook part to which closed-loop search is applied), overall sign, position in corresponding part of the pulse codebook.

The speech codec in which the above described scheme shall be introduced is run with a sufficient set of training speech data in order to derive the pulse codebook described before. To generate the stochastic excitation during the training process. the following is done:

The ideal RPE sequence is computed from the target vector to be rebuilt and the impulse response of the synthesis filter. The position of the first nonzero pulse, the maximum pulse position and the overall sign are taken from the ideal RPE as given above.

If the n-th nonzero sample of the ideal RPE sequence has maximum amount, the normalized RPE sequence is stored in the n-th database. The normalization is performed in two steps. In the first step, the RPE sequence is normalized such that the maximum pulse has positive value. In the second step. the sequence obtained after the first step is divided by the energy of the target vector to which the RPE sequence belongs. This is done to remove the influence of the loudness of the signal from the codebook entries. In this way, L databases are obtained. The databases contain "normalized waveforms". Therefore, also the codebooks trained based on the databases contain "normalized waveforms".

For each database, codebook training is performed separately according to the LBG-algorithm. (For details see description in Y. Linde, A. Buzo, R. M. Gray: "An Algorithm for Vector Quantizer Design", IEEE Transactions on Communications, January 1980).

Finally, the different codebooks are joined together such that the n-th part of the overall codebook contains candidate vectors where the n-th sample has maximum amount.

An example of the speech codec which employs the new stochastic codebook scheme is described below with reference to FIG. 5. Note that the block diagram or scheme doesn't depend on this codec. It can also be used with other CELP-type speech codecs.

Figure 5:
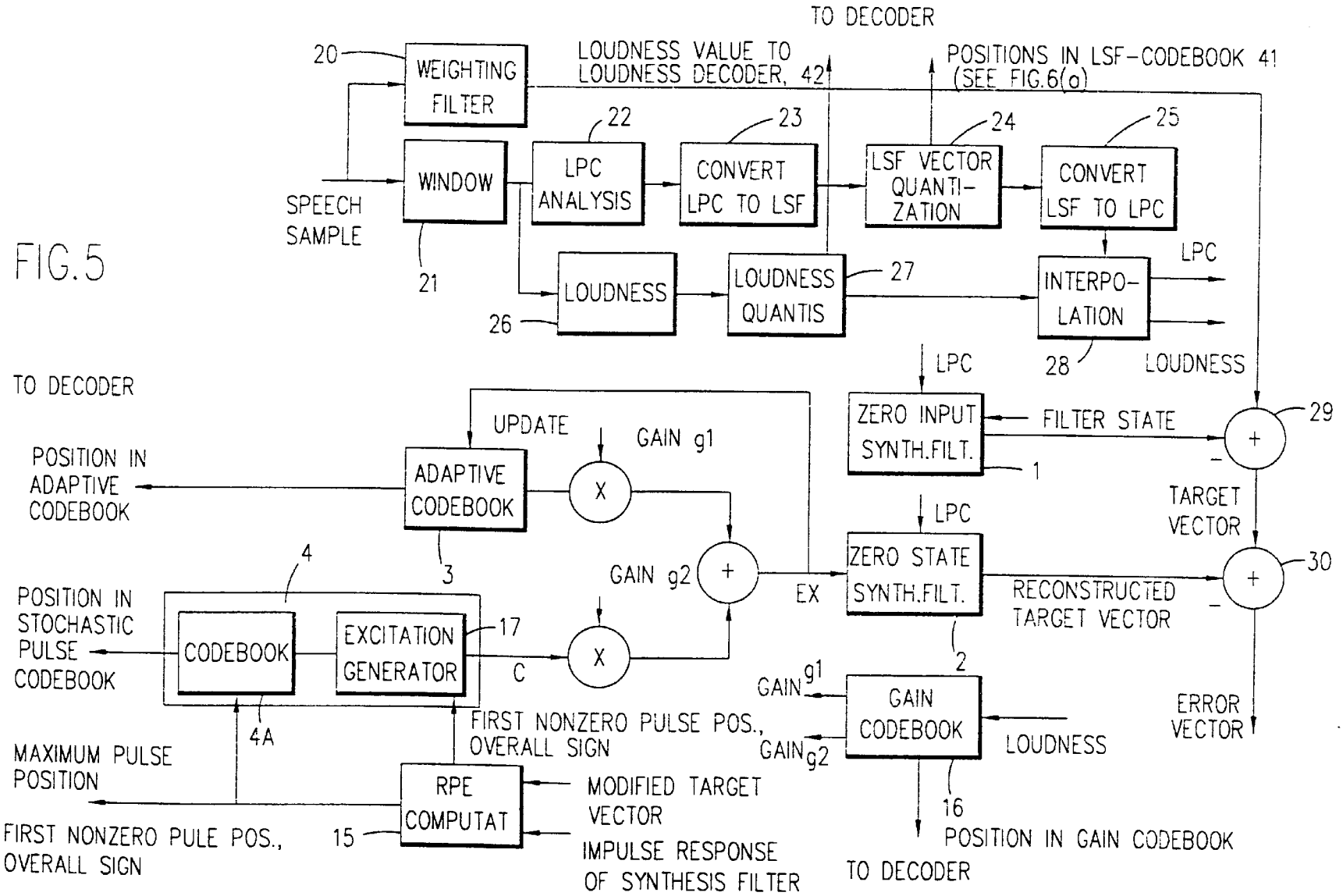
FIG. 5 depicts an example for a speech encoder as used for performing the speech synthesizing method according to the invention.

The synthesis filter shown in FIG. 5 gives the spectral envelope of the signal. Another interpretation is that the short term correlation of the signal is given by this filter. This filter is excited by vectors taken from codebooks which contain a reasonably large number of candidate vectors. One vector is taken from the adaptive codebook 3 where old excitation vectors are stored. This excitation part rebuilds the harmonic structure of speech (or the long term correlation of the speech signal) and is called the "adaptive excitation". The second part of the excitation is taken from the stochastic codebook 4. This codebook introduces the noisy parts of the synthesized speech signal or the innovation of the signal which cannot be provided by linear prediction.

With reference to FIG. 5, the computations are divided into frame and subframe processings. A speech frame consists of $N_{frame}$ speech samples. The codec delay is $N_{frame}$ times the sample period. Each frame has k subframes of the length $N_{frame}/k$ samples. Parameters which are computed once per frame are called "frame parameters". Parameters which are computed for each subframe are called "subframe parameters". First, the frame parameters are computed. These parameters are LPC's (Linear Predictive Coefficients) derived via blocks 21, 22, 23, 24, 25 and 28 (explained later) and loudness derived via blocks 21, 26, 27 and 28 (explained later).

The LPC's out of block 28 describe the spectral envelope and the loudness value gives the loudness of the signal in the current speech frame. Then, the excitation of this synthesis filter is calculated for each subframe. The excitation is described by the subframe parameters position in adaptive codebook 3, position in pulse codebook 4*a*, maximum pulse position in block 15, first nonzero pulse position in block 15, overall sign in block 15, and position in gain codebook 16.

Figure 6A:
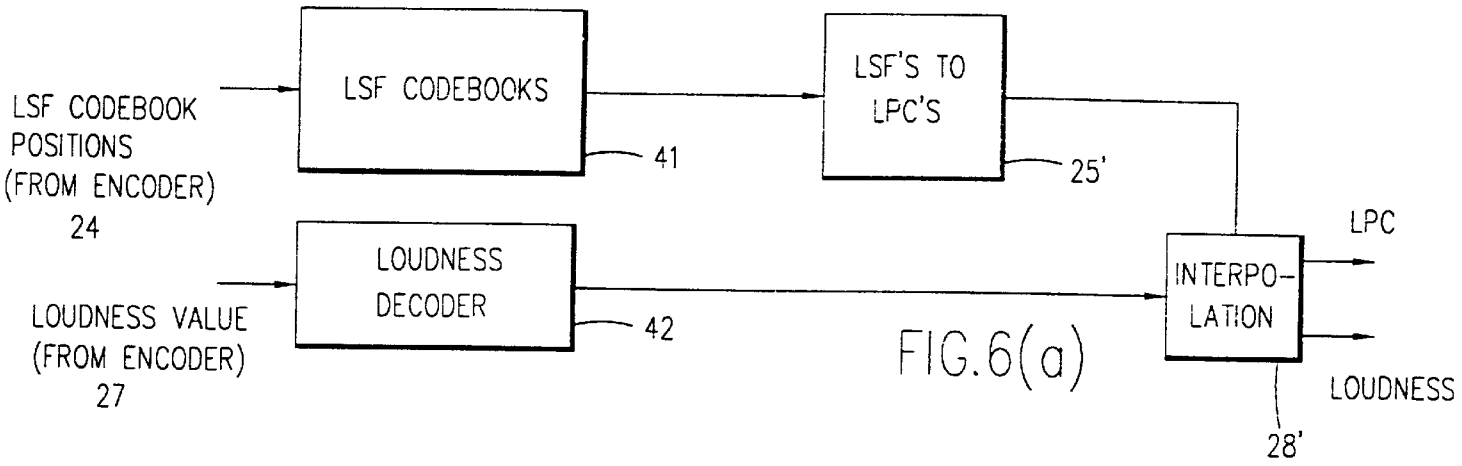
FIGS. 6(*a*) and 6(*b*) show for the reason of completeness of description an example of the speech decoder as used in connection with the speech encoder of FIG. 5.
Figure 6B:
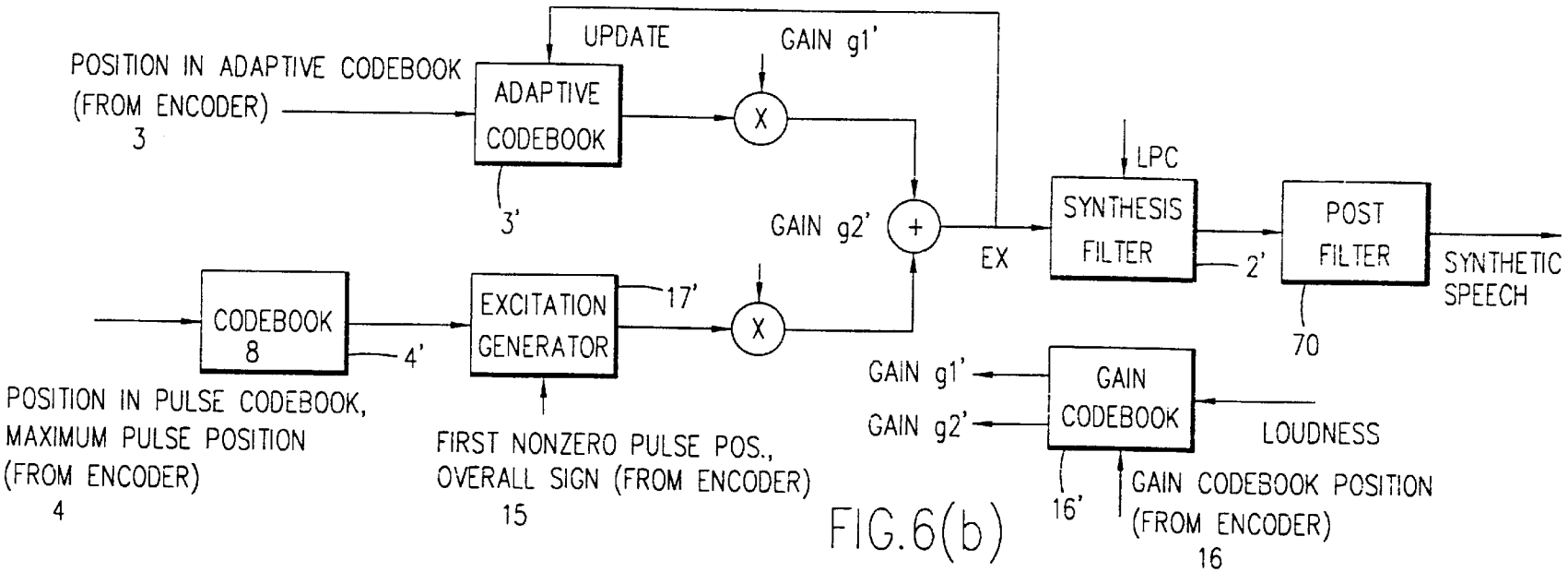

These parameters are transmitted to the decoder (see FIG. 6*b*).

Before entering the LPC-analysis stage, a current speech frame is windowed in block 21. LPC-analysis 22 is performed via LEVINSON-DURBIN recursion. The LPC's are transformed into LSF's (Line Spectrum Frequencies) in block 23 and vector-quantized in block 24. For further use in the encoder the quantized LSF's are converted into quantized LPC's in block 25. The LPC's are interpolated with the LPC's of the previous speech frame in block 28. A loudness value is computed from the windowed speech frame in block 26. quantized in block 27 and interpolated with the loudness value of the previous frame In block 28.

Each speech subframe is weighted in block 20 to enhance the perceptual speech quality. From the weighted speech subframe, the zero input response of the synthesis filter 1 is subtracted in a first substractor 29. The resulting signal is called "target vector". This target vector has to be rebuild by the "analysis-by-synthesis-loop". The following computations are done for each subframe.

First, the adaptive excitation is taken from the adaptive codebook 3. It is scaled by the optimal gain g1 and subtracted from the target vector in a second subtractor 30. The remaining signal is to be rebuilt by the stochastic excitation. In accordance with the invention, the ideal RPE sequence is computed from the remaining signal to be rebuild and the impulse response of the synthesis filter. The position of the first nonzero pulse, the maximum pulse position and the overall sign are taken from the ideal RPE as described above.

The RPE sequence is computed once before the closed loop codebook search is started. If the n-th nonzero sample of the ideal RPE has maximum amount, the codebook part n is searched closed-loop for the best excitation vector in blocks 4*a* via 14. Finally, the excitation of the synthesis filter is computed from the stochastic and adaptive excitations and the respective gains g1, g2 and the adaptive codebook 3 is updated.

FIG. 6(*a*) and 6(*b*) show in block diagrams essential parts of the decoder. As in most analysis-by-synthesis-coders the operations to be performed (except post processing) are quite similar to those ones already performed in the corresponding encoder stages. Accordingly, a detailed description of the schemes of FIG. 6(*a*) and 6(*b*) is omitted. To decode the transmitted parameters just a few table look-ups are required to obtain the filter coefficients for loudness and excitation of the synthesis filter.

As shown in FIG. 6(*b*), the price to pay for the sake of bit rate needed to transmit the speech signal is that it cannot be reconstructed completely. Noisy components (coding noise) are introduced by the speech encoder which can be heard (more or less). To avoid annoying effects, post filtering is employed. The target is to suppress the coding noise while retaining the naturalness of the speech signal. In this codec a post filter 70 including long term and short term filtering is employed to increase the perceptual speech quality.

Summarizing the above, instead of applying the search for the stochastic excitation to all pulse vector candidates, a hybrid search technique is used. After computation of the ideal RPE sequence, firstly the position of first nonzero pulse and the position of the maximum pulse are computed in the "ideal" pulse vector. Second, the codebook search is performed. Since there is one pulse vector codebook for each position of the maximum pulse, only the pulse vector codebook belonging to this position has to be searched for the "best" codevector. This technique according to the invention reduces the computational requirements for finding the "best" stochastic excitation drastically compared with applying the codebook search to all pulse vector codebooks.

What is claimed is:

1. A method of synthesizing a block of a speech signal in a CELP-type coder, the method comprising the steps of:

applying an excitation vector to a synthesizer filter of the coder, said excitation vector consisting of two gain normalized components derived from an adaptive codebook and from a stochastic codebook, for limiting the computational effort of the stochastic codebook components search, computing an ideal Regular Pulse Excitation (RPE) sequence followed by determining four parameters, namely the position of the first nonzero pulse of the ideal RPE excitation sequence, the position of the maximum pulse within said RPE excitation sequence, the overall sign of the regular pulse excitation sequence defined as the respective sign of said maximum pulse, and the position of the corresponding part of the pulse codebook, as the position of the maximum pulse, wherein the method further comprises a step of transmitting said four parameters to a speech decoder.

2. The method according to claim 1, wherein, in order to remove influence of the loudness of a speech signal from entries of the pulse codebook, there is a further step of normalizing the RPE sequences which are used for codebook-training.

3. The method according to claim 2, further comprising a step of performing normalization of said gain components in two steps, namely a first step in which the RPE sequence is modified such that the maximum pulse has positive value and in a second step in which the sequence obtained after the first step is divided by the energy of a target vector to which said RPE sequence belongs.

4. The method according to claim 1, wherein, in said step of computing the Regular Pulse Excitation sequence, the Regular Pulse Excitation sequence is computed from a target vector derived from a weighted speech sample signal and the pulse response of the synthesizer filter.

* * * * *